US005676106A

United States Patent [19]

Hoffman, II et al.

[11] Patent Number: 5,676,106

[45] Date of Patent: Oct. 14, 1997

[54] INJECTOR SYSTEM FOR AN OIL RENEWAL SYSTEM

[75] Inventors: John A. Hoffman, II, Peoria; C. Nickolas Goloff, Secor, both of Ill.

[73] Assignee: Caterpillar Inc., Peoria, Ill.

[21] Appl. No.: 763,962

[22] Filed: Dec. 10, 1996

[51] Int. Cl.[6] ..... F01M 11/04

[52] U.S. Cl. ..... 123/196 S; 123/73 AD

[58] Field of Search ..... 123/196 S, 73 AD; 184/1.5

[56] References Cited

U.S. PATENT DOCUMENTS

| | | | |
|---|---|---|---|
| 4,417,561 | 11/1983 | Yasuhara | 123/196 S |
| 4,674,456 | 6/1987 | Merritt | 123/196 S |
| 4,869,346 | 9/1989 | Nelson | 184/1.5 |
| 5,238,085 | 8/1993 | Engelmann | 123/196 S |
| 5,353,760 | 10/1994 | Zager | 123/196 S |
| 5,372,219 | 12/1994 | Peralta | 123/196 S |
| 5,390,762 | 2/1995 | Nelson | 123/196 S |

*Primary Examiner*—Erick R. Solis
*Attorney, Agent, or Firm*—Calvin E. Glastetter

[57] ABSTRACT

An injector system adaptable for outputting a predetermined volume of lubricating oil from a diesel engine into an engine fuel system includes a piston slidably disposed in a body and cooperates with the body to define a first and second chamber in the body at opposite ends of the piston. A controller controls the movement of a valve to alternately connect the first and second chambers to a pressurized source of oil so that fluid filling one chamber moves the piston which will expel fluid from the other chamber. The chamber remains filled until the valve is actuated to connect the unfilled chamber to the pressure source which causes the chamber to fill with oil and expel the oil from the previously filled chamber.

5 Claims, 1 Drawing Sheet

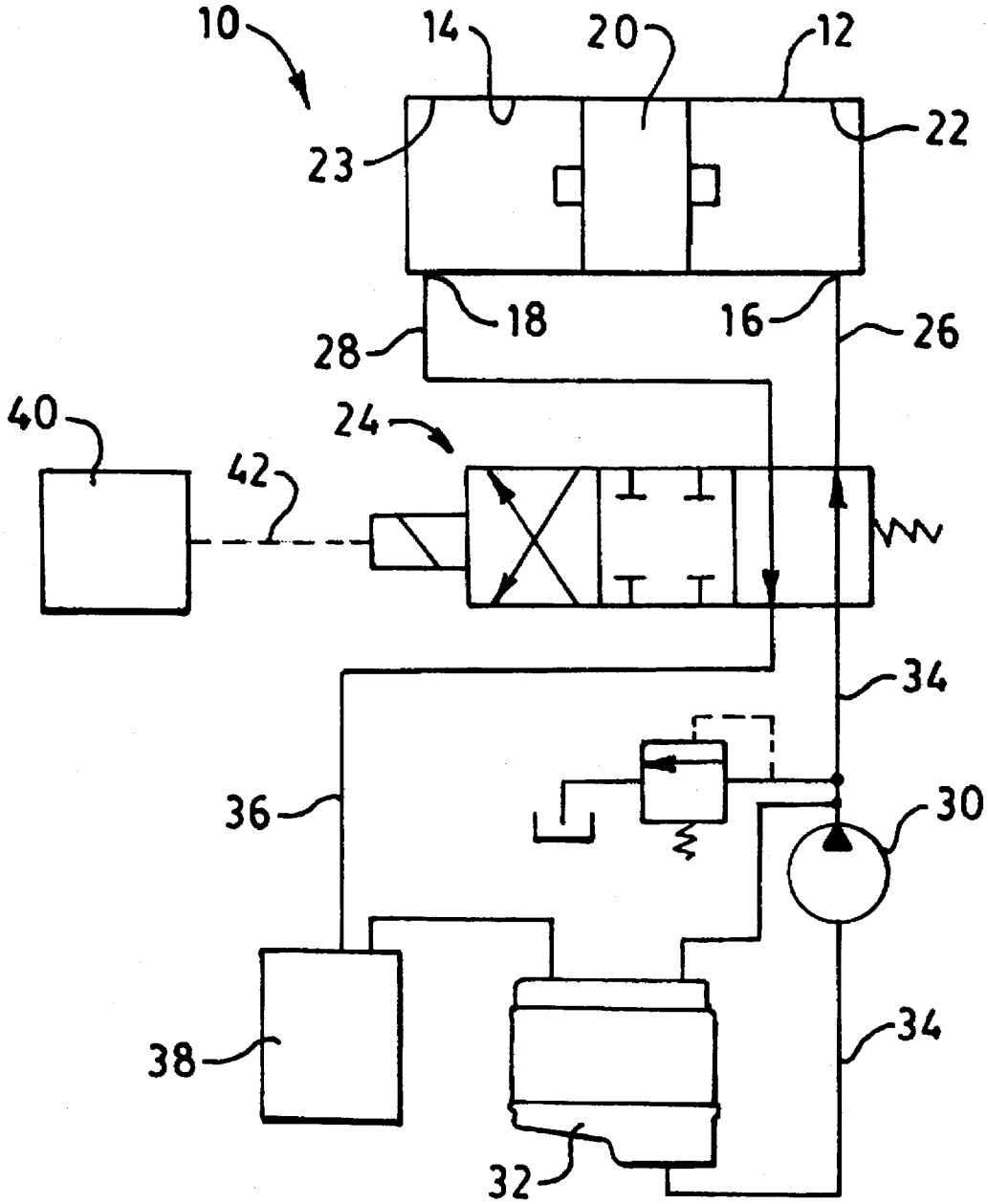
10
14
20
12
23
22
18
16
26
28
40
24
42
34
36
30
38
34
32

INJECTOR SYSTEM FOR AN OIL RENEWAL SYSTEM

TECHNICAL FIELD

This invention relates generally to fluid valves and more particularly to one which injects a finite amount of engine oil into the engine fuel system during every actuation of the valve.

BACKGROUND ART

Some diesel engines have an apparatus for increasing the time between oil change intervals so that down time of the machine is reduced. Typically those apparatuses periodically remove a small volume of used lubricating oil from the lubricating oil system, mix the used oil with the diesel fuel so that it is eventually burned during normal engine operation. Since the lubricating oil generally has a higher BTU rating than the diesel fuel one of the design parameters is that the apparatus be capable of precisely metering very small amounts of used lubricating oil for mixing with the fuel so as to not provide a mixture overly rich with lubricating oil.

While the current systems employ reliable electronic controllers for controlling the actuation of the metering valve, one of the problems encountered is that of the metering valve consistently delivering the designed quantity of lubricating oil under all operating conditions of the engine. To offset the inconsistency in the delivered amount of oil the control scheme for the metering valve generally requires several additional components to support its operation and/or sensors to insure that the proper amount of lubricating oil is dispensed into the fuel. Some of the factors that greatly influence the reliability of the system consistently delivering the designed quantity of oil is the pressure, viscosity, temperature, and the amount of contaminants of the used oil delivered to the injector valve. For example, most of the apparatuses use the pressurized oil from the lubricating system as the source of oil to the valve. The pressure of the lubricating system can vary drastically during normal operation of the engine and thereby greatly affects the amount of lubricating oil delivered over a period of time. Likewise, the viscosity or weight of the oil itself can be different in different engines depending on the operating environment. The temperature of the oil in each engine can vary over a range sufficient to influence the viscosity of the lubricating oil. Finally, while the apparatus is designed to reduce the contaminants in the lubricating oil, the amount of contaminants still increases over an extended period of time.

Thus in view of the above, it would be desirable to have an injection system which that will supply a precise, controlled volume of oil which is delivered to the fuel system each time the valve is actuated to connect the chamber to a pressure source. The amount of lubricating oil delivered to the fuel system is precisely controlled simply by controlling the number of times the valve is actuated per unit of time.

The present invention is directed to overcoming one or more of the problems as set forth above.

DISCLOSURE OF THE INVENTION

In one aspect of the present invention a fluid injector system for an oil renewal system having a pump for removing oil from an engine and mixing the oil with a fuel system includes a body having a bore therein and a first and a second opening into the bore, a piston slidably disposed within the bore and cooperating therewith to define a first and a second chamber in the body, a valve having a first position whereat pressurized oil from the engine is in communication with the first opening to fill the first chamber for moving the piston to expel the oil from the second chamber into the fuel system and a third position whereat pressurized oil from the engine is in communication with the second opening to fill the second chamber for moving the piston to expel the oil from the first chamber into the fuel system.

BRIEF DESCRIPTION OF THE DRAWINGS

The sole FIGURE is a view of a valve and associated system of the present invention.

BEST MODE FOR CARRYING OUT THE INVENTION

A fluid injector system 10 for outputting a fixed volume of fluid, such as lubricating oil, each time it is actuated includes a body 12 having a bore 14 therein and a first opening 16 and a second opening 18 into the bore. A piston 20 is slidably disposed within the bore 14 and cooperates with the body to define a first chamber 22 and a second chamber 23 in the body 12 at opposite ends of the piston. The chambers 22,23 are sized to hold a predetermined volume of fluid so that when fluid enters one chamber and moves the piston the same volume of fluid is expelled from the other chamber.

A four way two position solenoid actuated spring returned valve 24 is provided for communicating the fluid into and out of the body 12 by a first conduit 26 connected between the valve and the first opening 16 and a second conduit 28 connected between the valve and the second opening 18. The valve has a spring biased first position, a solenoid actuated second position and a transitional zone therebetween wherein all communication therethrough is blocked. When the valve is in its first position fluid is communicated from a pump 30 and fluid source such as a lubricating system of a diesel engine 32 through a conduit 34 and the conduit 26 into the first chamber 22 and the second chamber 23 is connected through the conduit 28 and a conduit 36 to direct expelled fluid from the chamber and inject the fluid into a fuel system such as a tank 38. When the valve is in its second position fluid is communicated from the pump 30 into the second chamber 23 and the fluid is expelled from the first chamber 22 and is injected into the fuel system. When the valve is moved between the first and second positions it moves through the transitional zone at which all flow therethrough is blocked. Although the valve is shown as a solenoid operated valve, it is recognized other forms of actuated valves could be used without departing from the scope of the invention.

A controller 40 is provided to send a signal 42 to the solenoid of the valve 24 to actuate the valve. The controller sends the signal to energize the solenoid to move the valve through the transitional zone to its second position. When no signal is present the solenoid is deenergized and the valve is spring biased to its first position. The controller will energize and deenergize the solenoid at a predetermined unit of time to ensure that the proper amount of fluid is directed into the fuel tank 38. The fluid injector system will provide two injections of the oil into the fuel system with only one actuation of the valve by the controller. One injection is provided when the solenoid is energized and the second injection is provided when the solenoid is deenergized and the valve is spring biased to its first position.

INDUSTRIAL APPLICABILITY

In use, the injector system 10 is designed to receive pressurized fluid at one chamber opening from a source of pressurized fluid such as a pump 30 and lubricating system of a diesel engine 32 while the other chamber opening is connected to, for example, the fuel system of the engine. With the solenoid deenergized, the valve 24 is spring biased to its first position which is the default position shown. At such position, the pressurized fluid in the conduit 34 passes through the valve 24, the conduit 26, the opening 16 into the first chamber 20. The pressurized fluid filling the first chamber 22 acts on the piston 20, shown in a central position within the bore 14, and moves the piston toward the second opening 18 and expels fluid from the second chamber 23 through conduits 28,36 into the fuel system 38. After a predetermined time unit interval the controller 40 energizes the solenoid and the valve 24 is moved through the transitional zone into the second position. With the valve 24 in the second position the pressurized fluid in the conduit 34 passes through the valve 24, the conduit 28, the second opening 18 into the second chamber 23. The pressurized fluid filling the second chamber 23 acts on the piston 20 and moves the piston toward the first opening 16 and expels the fluid from the first chamber 22 through the conduits 26,36 into the fuel system 38. At the predetermined time unit the controller will deenergize the solenoid and the valve is spring biased to the first position to again fill the first chamber 22 with fluid from the engine and expel the fluid from the second chamber 23 into the fuel system 38. The controller 40 control the time interval between energizing and deenergizing the solenoid so that the proper amount of oil is injected into the fuel system. The source of pressurized fluid is used to pressurize the chamber on one end of the piston thus moving the piston to expel fluid from the other chamber on the other end of the piston and for injected into the fuel system 38. The chamber will be self primed by the filling fluid so that on the next actuation of the valve the volume of fluid in the filled chamber is injected into the fuel system. The same volume of fluid entering one chamber will be expelled from the other chamber. The design of the present invention provides a positive and fixed volume of oil which is injected into the fuel system on each movement of the valve. The design also has a no flow through fault mode which prevents oil being injected into the fuel system when in the fault mode.

In view of the above, it is readily apparent that the injector system of the present invention provides a simplified fluid injection system which is not affected by differences in the inlet pressure, viscosity, or temperature of the oil entering the inlet, and has increased tolerance of contaminants in the oil. This is accomplished by directing pressurized fluid from the engine into one chamber to move the piston so that fluid is expelled from the other chamber and injected into the fuel system.

Other aspects, objects, and advantages of this invention can be obtained from a study of the drawing, the disclosure, and the appended claims.

We claim:

1. A fluid injector system for an oil renewal system having a pump for removing oil from an engine and mixing the oil with a fuel system, comprising:

a body having a bore therein and a first and a second opening into the bore;

a piston slidably disposed within the bore and cooperating therewith to define a first and a second chamber in the body; and a valve having a first position whereat pressurized oil from the engine is in communication with the first opening to fill the first chamber for moving the piston to expel the oil from the second chamber into the fuel system and a second position whereat pressurized oil from the engine is in communication with the second opening to fill the second chamber for moving the piston to expel the oil from the first chamber into the fuel system.

2. The injector system of claim 1 wherein the valve is spring biased to the first position and solenoid actuated to the second position.

3. The injector system of claim 2 including a controller for energizing the solenoid for moving the valve from the first position to the second position for filling the second chamber with pressurized oil so that the piston is moved to expel the oil from the first chamber into the fuel system and deenergizing the solenoid so that the spring biases the valve to its first position for filling the first chamber with pressurized oil so that the piston is moved to expel the oil from the second chamber into the fuel system.

4. The injector system of claim 3 wherein the chamber in communication with the pump is self primed and filled to a predetermined volume of engine oil as the same volume of oil is being expelled from the other chamber into the fuel system.

5. The injector system of claim 3 wherein the controller alternately energizes and deenergizes the valve at a predetermined unit of time.

* * * * *